US007931092B2

(12) United States Patent
Olinger

(10) Patent No.: US 7,931,092 B2
(45) Date of Patent: Apr. 26, 2011

(54) PACKER ELEMENT WITH RECESSES FOR DOWNWELL PACKING SYSTEM AND METHOD OF ITS USE

(75) Inventor: Robert L. Olinger, Front Royal, VA (US)

(73) Assignee: Stowe Woodward, L.L.C., Middletown, VA (US)

( * ) Notice: Subject to any disclaimer, the term of this patent is extended or adjusted under 35 U.S.C. 154(b) by 62 days.

(21) Appl. No.: 12/366,771

(22) Filed: Feb. 6, 2009

(65) Prior Publication Data

US 2009/0200043 A1 Aug. 13, 2009

Related U.S. Application Data

(60) Provisional application No. 61/028,306, filed on Feb. 13, 2008.

(51) Int. Cl.
*E21B 33/12* (2006.01)
*E21B 23/00* (2006.01)

(52) U.S. Cl. ..... 166/387; 166/120

(58) Field of Classification Search ..... 166/387, 166/120
See application file for complete search history.

(56) References Cited

U.S. PATENT DOCUMENTS

| | | | | |
|---|---|---|---|---|
| 6,834,725 | B2 | 12/2004 | Whanger et al. | |
| 6,840,325 | B2 | 1/2005 | Stephenson | |
| 6,907,937 | B2 | 6/2005 | Whanger et al. | |
| 7,013,979 | B2 * | 3/2006 | Richard | 166/369 |
| 7,059,415 | B2 | 6/2006 | Bosma et al. | |
| 7,063,164 | B2 | 6/2006 | Hilsman et al. | |
| 7,066,285 | B2 | 6/2006 | Shaarpour | |
| 7,070,001 | B2 | 7/2006 | Whanger et al. | |
| 7,143,832 | B2 * | 12/2006 | Freyer | 166/387 |
| 7,152,689 | B2 | 12/2006 | Hilsman et al. | |
| 7,228,915 | B2 | 6/2007 | Thomson | |
| 2005/0269108 | A1 | 12/2005 | Whanger et al. | |
| 2007/0056735 | A1 | 3/2007 | Bosma et al. | |
| 2007/0144733 | A1 | 6/2007 | Murray et al. | |
| 2007/0221387 | A1 | 9/2007 | Levy | |
| 2009/0139707 | A1 * | 6/2009 | Berzin et al. | 166/118 |
| 2009/0242189 | A1 * | 10/2009 | Vaidya et al. | 166/134 |

FOREIGN PATENT DOCUMENTS

| | | | |
|---|---|---|---|
| EP | 1 407 113 | B1 | 3/2006 |
| EP | 1 423 583 | B1 | 3/2006 |
| WO | WO 03/008756 | A1 | 1/2003 |
| WO | WO 03/023185 | A1 | 3/2003 |
| WO | WO 2005/090741 | A1 | 9/2005 |
| WO | WO 2006/003112 | A1 | 1/2006 |
| WO | WO 2006/003113 | A1 | 1/2006 |
| WO | WO 2006/045794 | A1 | 5/2006 |
| WO | WO 2006/053896 | A1 | 5/2006 |
| WO | WO 2006/063988 | A1 | 6/2006 |
| WO | WO 2007/084657 | A1 | 7/2007 |

* cited by examiner

*Primary Examiner* — David J Bagnell
*Assistant Examiner* — Catherine Loikith
(74) *Attorney, Agent, or Firm* — Myers Bigel Sibley & sajovec

(57) ABSTRACT

A packer system for a wellbore includes a tubular member and a packer element mounted on the tubular member. The packer element is formed of a swellable polymeric material, the packer element having a radially-outward external surface, the surface including a plurality of radially-inwardly extending recesses formed therein. The recesses provide additional surface area that can contact a swelling fluid, thereby increasing the swelling rate of the packer element.

18 Claims, 5 Drawing Sheets

PACKER ELEMENT WITH RECESSES FOR DOWNWELL PACKING SYSTEM AND METHOD OF ITS USE

RELATED APPLICATION

The present application claims priority from U.S. Provisional Patent Application Ser. No. 61/028,306, filed Feb. 13, 2008, the disclosure of which is hereby incorporated herein in its entirety.

FIELD OF THE INVENTION

The present invention relates generally to a wellbore system for oil exploration, and more particularly to a packer for a wellbore system.

BACKGROUND OF THE INVENTION

A downhole wellbore system typically includes a pipe or other tubular structure that extends into a borehole drilled into the ground. In some instances, a casing is inserted into the wellbore to define its outer surface; in other instances, the rock or soil itself serves as the wall of the wellbore.

Many wellbore systems include a packer, which is designed to expand radially outwardly from the pipe against the walls of the wellbore. The packer is intended to seal segments of the pipe against the wellbore in order to isolate some sections of the wellbore from others. For example, it may be desirable to isolate a section of the formation that includes recoverable petroleum product from an aquifer.

Known sealing members for packers include, for example, mechanical packers which are arranged in the borehole to seal an annular space between a wellbore casing and a production pipe extending into the borehole. Such a packer is radially deformable between a retracted position, in which the packer is lowered into the borehole, and an expanded position, in which the packer forms a seal. Activation of the packer can be by mechanical or hydraulic means. One limitation of the applicability of such packers is that the seal surfaces typically need to be well defined, and therefore their use may be limited to wellbores with casings. Also, they can be somewhat complicated and intricate in their construction and operation. An exemplary mechanical packer arrangement is discussed in U.S. Pat. No. 7,070,001 to Whanger et al., the disclosure of which is hereby incorporated herein in its entirety.

Another type of annular seal member is formed by a layer of cement arranged in an annular space between a wellbore casing and the borehole wall. Although in general cement provides adequate sealing capability, there are some inherent drawbacks such as shrinking of the cement during hardening, which can result in de-bonding of the cement sheath, or cracking of the cement layer after hardening.

Additional annular seal members for packers have been formed of swellable elastomers. These elastomers expand radially when exposed to an activating liquid, such as water (often saline) or hydrocarbon, that is present in the wellbore. Exemplary materials that swell in hydrocarbons include ethylene propylene rubber (EPM and EPDM), ethylene-propylene-diene terpolymer rubber (EPT), butyl rubber, brominated butyl rubber, chlorinated butyl rubber), chlorinated polyethylene, neoprene rubber, styrene butadiene copolymer rubber (SBR), sulphonated polyethylene, ethylene acrylate rubber, epichlorohydrin ethylene oxide copolymer, silicone rubbers and fluorsilicone rubber. Exemplary materials that swell in water include starch-polyacrylate acid graft copolymer, polyvinyl alcohol cyclic acid anhydride graft copolymer, isobutylene maleic anhydride, acrylic acid type polymers, vinylacetate-acrylate copolymer, polyethylene oxide polymers, carboxymethyl cellulose type polymers, starch-polyacrylonitrile graft copolymers and the like and highly swelling clay minerals such as sodium bentonite. Exemplary swellable packers are discussed in U.S. Pat. No. 7,059,415 to Bosma et al. and U.S. Patent Publication No. 2007/0056735 to Bosma et al., the disclosure of each of which is hereby incorporated herein in its entirety.

In some swellable systems, it can be difficult to control the timing of expansion of different sections of the packer. For example, if the ends of the packer seal prior to the center, it may be difficult or impossible for swelling fluid to reach the center portion of the packer. It is not uncommon for the ends of the packer to swell more rapidly than the center portion, as swelling fluid can enter the end portions both axially and radially, whereas fluid can enter the center portion only radially. In such instances, swelling of the center portion of the packer may decrease or cease entirely. Incomplete swelling of the central portions of the packer can cause lower sealing force against the walls of the well bore in these portions; thus, compromising the sealing ability of the packer element. As such, it may be desirable to provide a packer system in which this shortcoming can be addressed.

SUMMARY OF THE INVENTION

As a first aspect, embodiments of the present invention are directed to a packer system for a wellbore. The packer system comprises a tubular member and a packer element mounted on the tubular member. The packer element is formed of a swellable polymeric material, the packer element having a radially-outward external surface, the surface including a plurality of radially-inwardly extending recesses formed therein. The recesses provide additional surface area that can contact a swelling fluid, thereby increasing the swelling rate of the packer element.

As a second aspect, embodiments of the present invention are directed to a packer system for a wellbore, comprising: a tubular member; and a plurality of packer elements mounted on the tubular member. Each of the packer elements is formed of a swellable polymeric material and has a radially-outward external surface, the surfaces of at least one of the packer elements including a plurality of radially-inwardly extending recesses formed therein. The packer elements are arranged in stacked coaxial relationship. The plurality of recesses on a first packer element have greater surface area per axial unit of length than the plurality of recesses of a second packer element. In this configuration, the packer elements can swell at different rates. In one embodiment, end regions of a cylindrical packer that have less recessed area than a central region of the packer can swell at a slower rate, thereby allowing the central region of the packer to swell into contact with the walls of the wellbore sooner than the end portions. This behavior can address the shortcomings of prior packing elements described above whose end portions seal prior to the complete swelling of central portions.

As a third aspect, embodiments of the present invention are directed to a method of isolating a first section of a wellbore from a second section. The method comprises: providing a packer system having a tubular member and a packer element, the packer element mounted on the tubular member and formed of a swellable polymeric material, the packer element having a radially-outward external surface, the surface including a plurality of radially-inwardly extending recesses formed therein; positioning the packer system in a wellbore; contacting the external surface with the swelling fluid; and permitting the packer element to swell sufficiently to contact walls of the wellbore, thereby isolating at least the first section of the wellbore from the second section of the wellbore.

DETAILED DESCRIPTION OF EMBODIMENTS OF THE INVENTION

Figure 1:
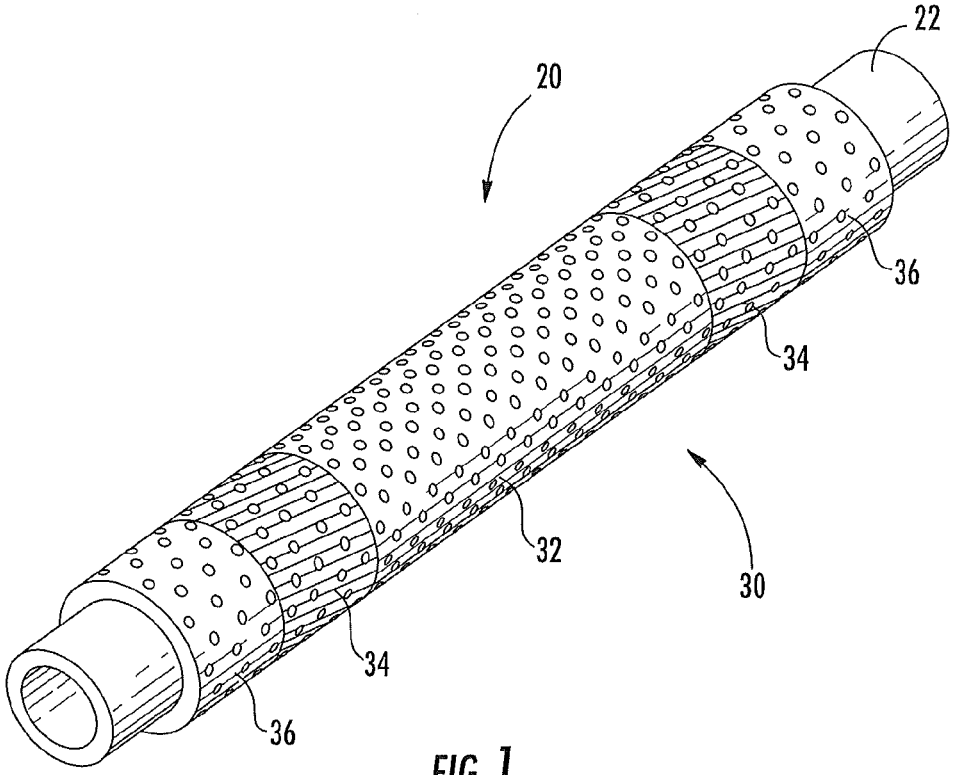
FIG. 1 is a perspective view of a packer system according to embodiments of the present invention, wherein differently shaded regions indicate different degrees of surface area exposure via recesses in the outer surface of the various regions.
Figure 2:
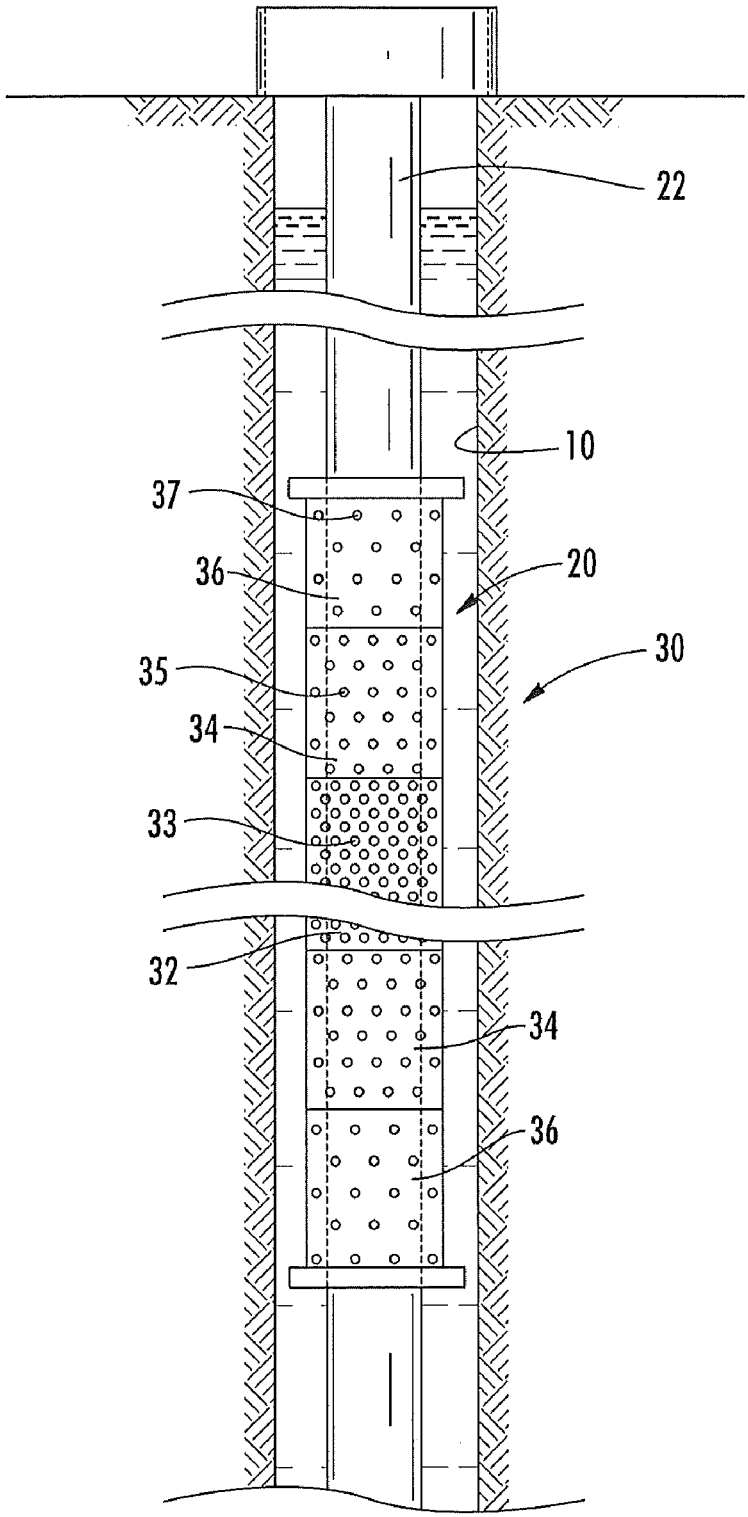
FIG. 2 is a side section view of the packer system of FIG. 1 shown in a wellbore, wherein none of the elements of the packer system have begun to swell.

The present invention will now be described more fully hereinafter, in which preferred embodiments of the invention are shown. This invention may, however, be embodied in different forms and should not be construed as limited to the embodiments set forth herein. Rather, these embodiments are provided so that this disclosure will be thorough and complete, and will fully convey the scope of the invention to those skilled in the art. In the drawings, like numbers refer to like elements throughout. Thicknesses and dimensions of some components may be exaggerated for clarity.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein the expression "and/or" includes any and all combinations of one or more of the associated listed items.

In addition, spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

Well-known functions or constructions may not be described in detail for brevity and/or clarity.

Turning now to the figure, a downwell pipe assembly, designated broadly at 20, is shown in FIG. 1. The assembly 20 is inserted into a wellbore, which is defined by walls in the earth. In some embodiments the assembly 20 may be disposed within a casing or other annular member that is inserted in the earth, or it may be inserted directly into the earth. In addition, the wellbore may be substantially vertically disposed, substantially horizontally disposed or disposed at any angle typically used for wells. As used herein, the term "wellbore" is intended to encompass any of these scenarios.

A packer system 30 is mounted to a segment of a base pipe 22. The packer system 30 includes a plurality of packer elements: in the illustrated embodiment, the system 30 includes a center element 32, two intermediate elements 34 that sandwich the center element 32, and two end elements 36 that sandwich the intermediate elements 34. In the illustrated embodiment, the elements 32, 34, 36 abut each other; however, in some embodiments gaps may exist between some or all of the elements. Also, different numbers of elements (including a single element) may be employed.

The elements 32, 34, 36 are formed of a material, typically an elastomer, that swells when contacted with a swelling fluid. Most common swelling fluids include water and hydrocarbons. The elements 32, 34, 36 thus typically comprise materials that are selected for their ability to swell when in contact with water or hydrocarbon, depending on the projected location of the packer system 30 within the wellbore 10. Exemplary elastomeric materials that swell in hydrocarbons include ethylene propylene rubber (EPM and EPDM), ethylene-propylene-diene terpolymer rubber (EPT), butyl rubber, brominated butyl rubber, chlorinated butyl rubber), chlorinated polyethylene, neoprene rubber, styrene butadiene copolymer rubber (SBR), sulphonated polyethylene, ethylene acrylate rubber, epichlorohydrin ethylene oxide copolymer, silicone rubbers and fluorsilicone rubber. Exemplary elastomeric materials that swell in water include starch-polyacrylate acid graft copolymer, polyvinyl alcohol cyclic acid anhydride graft copolymer, isobutylene maleic anhydride, acrylic acid type polymers, vinylacetate-acrylate copolymer, polyethylene oxide polymers, carboxymethyl cellulose type polymers, starch-polyacrylonitrile graft copolymers and the like.

The swellable elastomer may also include fillers and additives that enhance its manufacturing or performance properties and/or reduce its costs. Exemplary filler materials include inorganic oxides such as aluminum oxide ($Al_2O_3$), silicon dioxide ($SiO_2$), magnesium oxide (MgO), calcium oxide (CaO), zinc oxide (ZnO) and titanium dioxide ($TiO_2$), carbon black (also known as furnace black), silicates such as clays, talc, wollastonite ($CaSiO_3$), magnesium silicate ($MgSiO_3$), anhydrous aluminum silicate, and feldspar ($KAlSi_3O_8$), sulfates such as barium sulfate and calcium sulfate, metallic powders such as aluminum, iron, copper, stainless steel, or nickel, carbonates such as calcium carbonate ($CaCo_3$) and magnesium carbonate ($MgCo_3$), mica, silica (natural, fumed, hydrated, anhydrous or precipitated), and nitrides and carbides, such as silicon carbide (SiC) and aluminum nitride (AlN). These fillers may be present in virtually any form, such as powder, pellet, fiber or sphere. Exemplary additives include polymerization initiators, activators and accelerators, curing or vulcanizing agents, plasticizers, heat stabilizers, antioxidants and antiozonants, coupling agents, pigments, and the like, that can facilitate processing and enhance physical properties.

The swelling elastomer may also include a swelling agent. In some embodiments, the swelling agent may be a sorbent for hydrocarbon. Also, in some embodiments the swelling agent may comprise polyethylene and/or other low molecular weight (LMW) polymers (i.e., polymers having a molecular weight of less than about 250,000), which may be combined with a hydrocarbon wax or the like. Other suitable swelling agents include thermoplastic polymer and copolymer mixtures and polyalphaolefins. Exemplary hydrocarbon swelling agents are the RUBBERIZER® sorbent, available from Haz-Mat Response Technologies, San Diego, Calif., VYBAR® polymers, available from Baker Petrolite (Sugar Land, Tex.), and AQUA N-CAP polymer, available from RTA Systems, (Oklahoma City, Okla.).

The central element 32 of the packer system 30 includes recesses 33 in its outer surface that provide additional surface area to be exposed to swelling fluid. The recesses 33 are illustrated as holes (e.g., blind-drilled holes), but can be in any form that provides additional surface area, including grooves, channels, vents, a roughened texture due to grinding, or the like. These recesses 33 provide surface area for direct contact with the swelling fluid, which in turn can enable the central element 32 to swell more rapidly than if it had only a smooth outer surface. The recesses 33 may be of any size (although the recesses 33 shown in FIGS. 1-5 are exaggerated in size for clarity); if the recesses 33 are blind-drilled holes, they typically have diameters of between about 1/32 and 1/8 inch and a depth of between about 1/8 and 1 inch. In some embodiments, the recesses 33 may have a surface area that is between about 25 and 550 percent of the surface area of the external surface of the element 32.

Each of the intermediate elements 34 has recesses 35 of the variety discussed above with respect to the central element 32; however, the recesses 35 of the intermediate elements 34 are configured to expose less additional surface area per axial unit of length to the swelling fluid than the central element 32. For example, the recesses 35 may be shallower, or less numerous, or shaped differently, than those of the central element 32. As such, the intermediate elements 34 swell more rapidly than they would if the outer surfaces were smooth, but less rapidly than the central element 32.

Each of the end elements 36 has recesses 37 of the variety discussed above that expose less surface area per axial unit of length than that exposed by the intermediate elements 34. However, in alternative embodiments, the end elements 36 may have no recesses at all. It should be noted that, in the illustrated embodiment, each of the end elements has no exposed axial surface that may contact swelling fluid due to the presence of end caps, which can reduce or eliminate axial surface contact in order to slow the rate of swelling of the end elements 36, but in other embodiments end caps may be absent.

Figure 3:
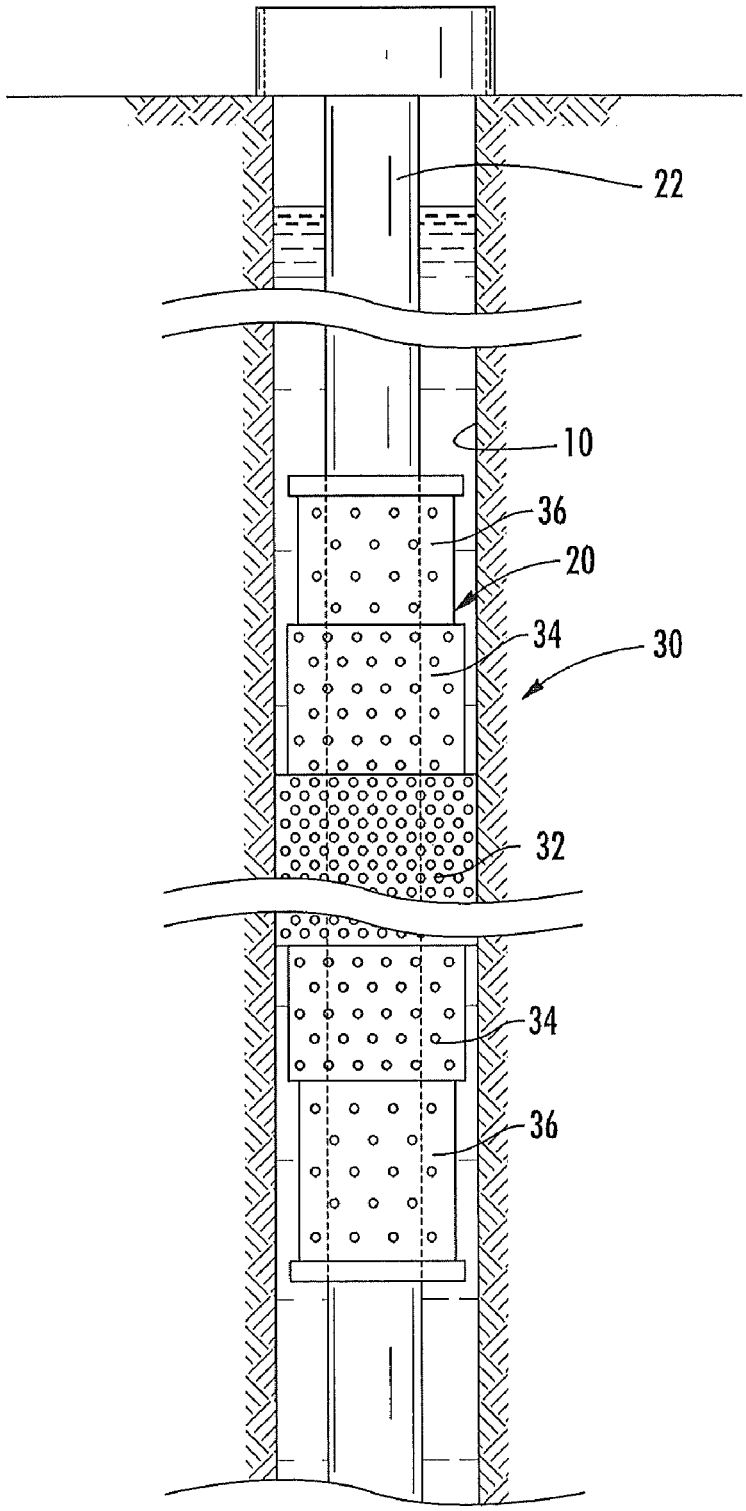
FIGS. 3-5 are side section view of the packer system and wellbore of FIG. 2 showing progressive swelling of the packer system elements.
Figure 4:
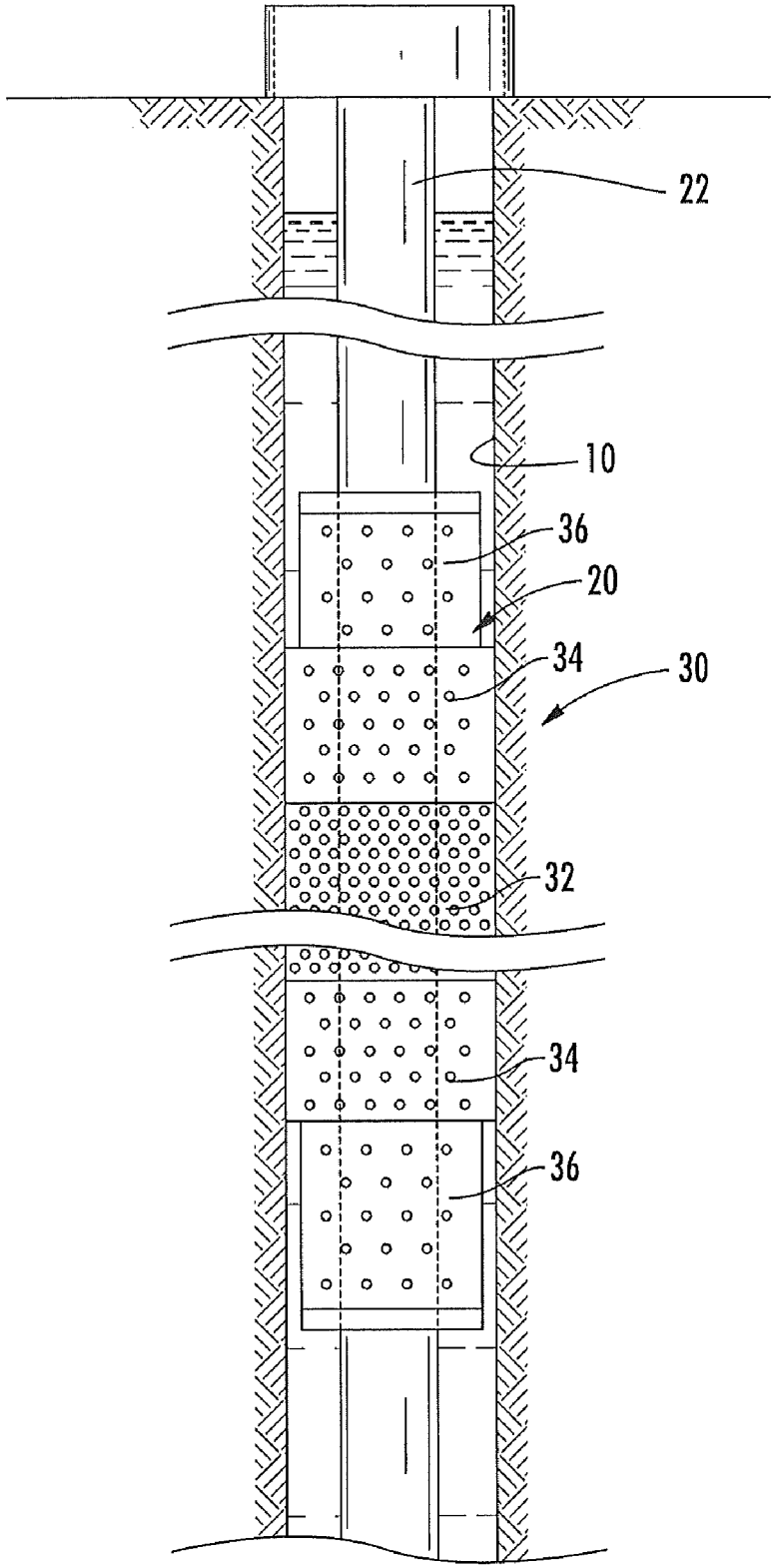
Figure 5:
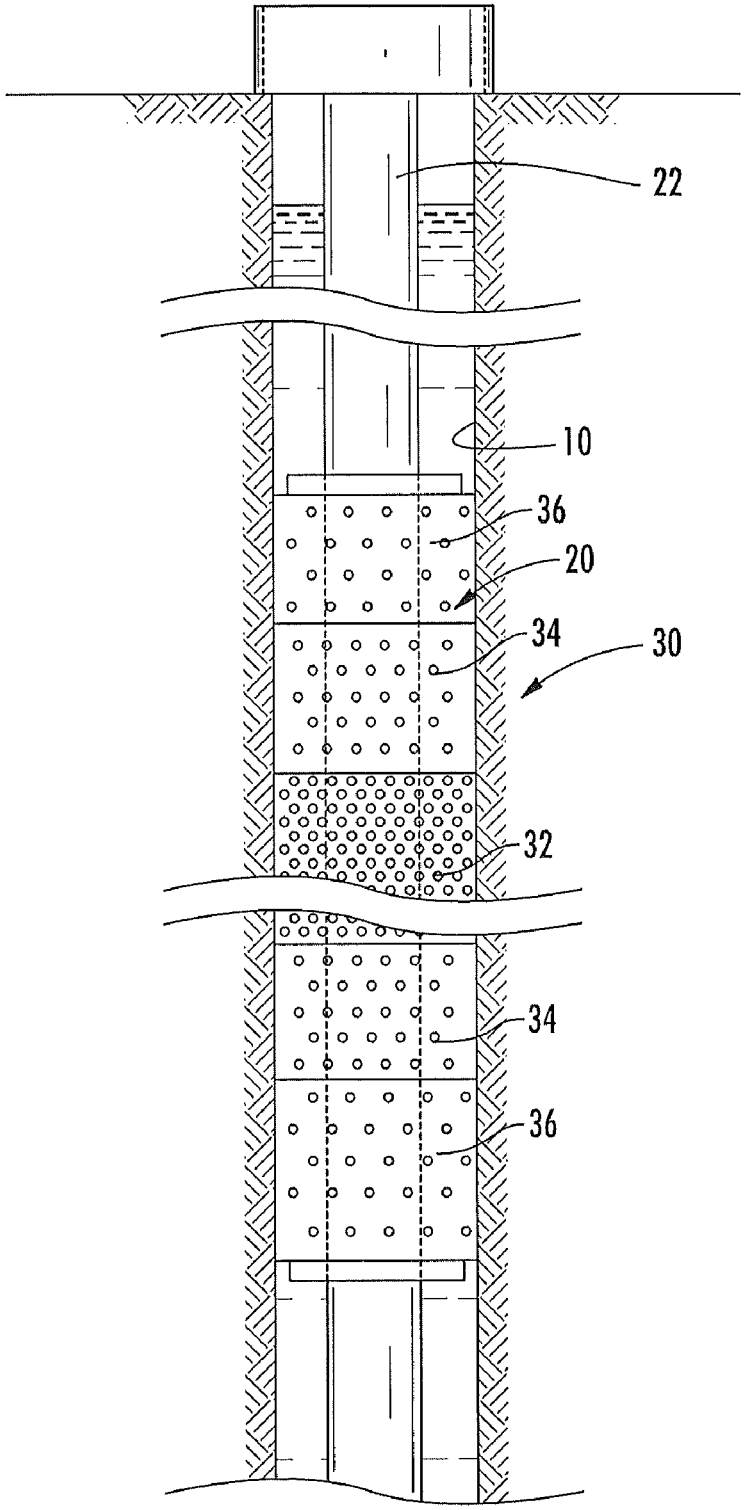

Thus, once the packer system 30 is inserted into a wellbore (FIG. 2), upon contact with the swelling fluid the center element 32, due to its increased exposed surface area, swells more rapidly than the intermediate or end elements 34, 36. Thus, the center element 32 swells sufficiently to contact and seal against the walls of the wellbore before the intermediate and end sections 34, 36 (FIG. 3). Continued exposure to the swelling fluid causes the intermediate elements 34 to next contact and seal against the walls of the wellbore 10 (FIG. 4), which is then followed by the sealing of the end elements 36 against the walls of the wellbore 10 (FIG. 5). With an arrangement such as that described above, in which the more central elements swell more quickly than the endmost elements, the end elements 36 do not seal against the walls of the wellbore 10 prior to the complete swelling and sealing of the center elements 32. As such, the risk of inadequate sealing pressure against the walls of the wellbore occurring (whether the wellbore is cased or un-eased) is reduced.

Those skilled in this art will appreciate that other embodiments may also be suitable. As one example, the packer elements may be combined into a single unitary structure, with different regions recessed differently and representing the "elements" discussed above. As another example, the packer system 30 may be thicker at its center than toward its ends. For example, it may comprise multiple distinct elements of different diameters, a single tapered structure, or even a single structure with a "stepped" profile with elements of different diameters rather than being tapered, in order to enable the center region of the packer system to contact the walls of the wellbore prior to the end portions. Also, if multiple distinct elements such as elements 32, 34, 36 are employed, the materials of each may vary, such that the system includes central elements that are not only offer more surface area for contact with swelling fluid than the end elements, but also swell more rapidly. As another alternative, a coating over the packer elements that breaks down once the packer system is positioned in the wellbore may be employed, with such coating being thicker on the end elements (and, therefore, slower to break down) than on the center elements. Of course, the numbers of elements may also vary depending on the environment of use. In any of these embodiments, the surface area of the elements can help to control the rate of swelling.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention.

That which is claimed is:

1. A packer system for a wellbore, comprising:

a tubular member; and a plurality of packer elements mounted on the tubular member, each of the packer elements formed of a swellable polymeric material and having a radially-outward external surface, the surfaces of at least one of the packer elements including a plurality of radially-inwardly extending recesses formed therein;

wherein the packer elements are arranged in stacked coaxial relationship; and wherein the plurality of recesses on a first packer element have greater surface area per axial unit of length than the plurality of recesses of a second packer element.

2. The packer system defined in claim 1, wherein the first packer element is axially nearer the center of the stack of packer elements than the second packer element.

3. The packer system defined in claim 1, wherein the surface area of the plurality of recesses of the first packer element is at least 25 percent of the surface area of the external surface.

4. The packer system defined in claim 1, wherein the recesses of the first packer element have a diameter of between about 1/32 and 1/8 inches.

5. The packer system defined in claim 1, wherein the swellable polymeric material is a hydrocarbon-swellable material.

6. The packer system defined in claim 5, wherein the hydrocarbon-swellable polymer is selected from the group consisting of: ethylene propylene rubber, ethylene-propylene-diene terpolymer rubber, butadiene rubber, brominated butadiene rubber, chlorinated butadiene rubber, chlorinated polyethylene, neoprene rubber, styrene butadiene copolymer rubber, sulphonated polyethylene, ethylene acrylate rubber, epichlorohydrin ethylene oxide copolymer, silicone rubbers and fluorsilicone rubber.

7. The packer system defined in claim 1, wherein the swellable polymer is a water-swellable polymer.

8. The packer system defined in claim 7, wherein the water-swellable polymer is selected from the group consisting of: starch-polyacrylate acid graft copolymers; polyvinyl alcohol cyclic acid anhydride graft copolymers; isobutylene maleic anhydride; acrylic acid type polymers, vinylacetate-acrylate copolymers; polyethylene oxide polymers; carboxymethyl cellulose type polymers; and starch-polyacrylonitrile graft copolymers.

9. The packing system defined in claim 1, wherein each of the packing elements is generally annular.

10. A method of isolating a first section of a wellbore from a second section, comprising:

providing a packer system having a tubular member, a first packer element, and a second packer element, the first and second packer elements mounted on the tubular member and formed of a swellable polymeric material, the first packer element having a first radially-outward external surface, the first surface including a plurality of radially-inwardly extending recesses formed therein, the second packer element having a second radially-outward external surface, the second surface including a plurality of radially-inwardly extending recesses formed therein, wherein the plurality of recesses on the first surface have greater surface area per axial unit of length than the plurality of recesses of the second packer element;

positioning the packer system in a wellbore;

contacting the external surface with a swelling fluid; and permitting the packer element to swell sufficiently to contact walls of the wellbore, thereby isolating at least the first section of the wellbore from the second section of the wellbore.

11. The method defined in claim 10, wherein the first packer element is mounted axially nearer the center of the tubular member than the second packer element.

12. The method defined in claim 10, wherein the surface area of the plurality of recesses of the first packer element is at least 25 percent of the surface area of the external surface.

13. The method defined in claim 10, wherein the recesses of the first packer element have a diameter of between about 1/32 and 1/8 inches.

14. The method defined in claim 10, wherein the swellable polymeric material is a hydrocarbon-swellable material.

15. The method defined in claim 14, wherein the hydrocarbon-swellable polymer is selected from the group consisting of: ethylene propylene rubber, ethylene-propylene-diene terpolymer rubber, butadiene rubber, brominated butadiene rubber, chlorinated butadiene rubber, chlorinated polyethylene, neoprene rubber, styrene butadiene copolymer rubber, sulphonated polyethylene, ethylene acrylate rubber, epichlorohydrin ethylene oxide copolymer, silicone rubbers and fluorsilicone rubber.

16. The method defined in claim 10, wherein the swellable polymer is a water-swellable polymer.

17. The method defined in claim 16, wherein the water-swellable polymer is selected from the group consisting of: starch-polyacrylate acid graft copolymers; polyvinyl alcohol cyclic acid anhydride graft copolymers; isobutylene maleic anhydride; acrylic acid type polymers, vinylacetate-acrylate copolymers; polyethylene oxide polymers; carboxymethyl cellulose type polymers; and starch-polyacrylonitrile graft copolymers.

18. The method defined in claim 10, wherein each of the first and second packing elements is generally annular.

* * * * *